US006709064B2

(12) United States Patent
Nettek

(10) Patent No.: US 6,709,064 B2
(45) Date of Patent: Mar. 23, 2004

(54) METHOD AND DEVICE FOR DETACHING OR CUTTING OUT AN EMBEDDED MANHOLE FRAME

(75) Inventor: Manfred Nettek, Seeboden (AT)

(73) Assignee: M. Nettek International, Inc., Technology Development & Marketing, Gordonsville, VA (US)

( * ) Notice: Subject to any disclaimer, the term of this patent is extended or adjusted under 35 U.S.C. 154(b) by 0 days.

(21) Appl. No.: 10/267,664

(22) Filed: Oct. 10, 2002

(65) Prior Publication Data

US 2003/0222495 A1 Dec. 4, 2003

(30) Foreign Application Priority Data

May 31, 2002 (EP) ..... 02012068

(51) Int. Cl.[7] ..... E21C 25/00; E01C 23/00; E02D 29/14

(52) U.S. Cl. ..... 299/39.3; 299/41.1; 299/39.1; 299/75; 404/25; 52/21

(58) Field of Search ..... 299/39.1, 39.3, 299/41.1, 75; 404/25, 112; 52/20, 21

(56) References Cited

U.S. PATENT DOCUMENTS 6,161,985 A 12/2000 Hinkle et al.
6,536,987 B2 * 3/2003 Chang ..... 404/25

FOREIGN PATENT DOCUMENTS

| | | | |
|---|---|---|---|
| DE | 198 40 267 A1 | | 3/2000 |
| DE | 200 22 889 U1 | | 6/2002 |
| EP | 0 796 950 A1 | | 9/1997 |
| JP | 2001-62827 | * | 3/2001 |
| JP | 2002-240030 | * | 8/2002 |

* cited by examiner

*Primary Examiner*—Heather Shackelford
*Assistant Examiner*—Sunil Singh
(74) *Attorney, Agent, or Firm*—Venable LLP; Catherine M. Voorhees

(57) ABSTRACT

A method for detaching a manhole frame (7) that is embedded in a road surface, wherein the manhole frame (7) is cut horizontally starting from the inside, without significant exposure of the outside area surrounding the manhole frame (7), by using a horizontally oriented rotating cutting blade (15) that performs eccentric circumferential runs along the inside of the manhole frame.

8 Claims, 4 Drawing Sheets

METHOD AND DEVICE FOR DETACHING OR CUTTING OUT AN EMBEDDED MANHOLE FRAME

CROSS-REFERENCE TO RELATED APPLICATION

This application is based on and claims the priority date of European Patent Application No. 02 012 068.9, filed on May 31, 2002.

BACKGROUND OF THE INVENTION

The invention relates to a method and an associated apparatus for detaching an embedded manhole frame.

To replace the manhole frames of manhole covers, e.g., in case of damage, the prior art calls for breaking up the asphalt or concrete road surface in which the manhole frame is embedded, preferably with pneumatic tools, until the manhole frame is easily accessible with the tools. After separating the manhole frame from the asphalt or concrete road surface and detaching it from the manhole cone or brickwork, the manhole frame can be lifted out manually, often piece-by-piece. The manhole cone can be damaged easily during this operation as a result of scraping, which reduces its load-carrying capability. For a high-quality reconstruction, the area where the road surface is broken up must be freed up to the manhole cone and the manhole cone must then be reconstructed, starting with the upper cone edge. The large area of repair and the considerable expenditure for the repair is a disadvantage.

Accordingly, it is the object of the present invention to provide a method for detaching an embedded manhole frame and a device that is particularly suitable for realizing this method. The method calls for a quick and low-cost removal of the manhole frame, without having to free a larger area around the manhole frame and the manhole cone, and without damaging the manhole cone section adjacent to the manhole frame. The method and device should lend themselves to a high degree of automation.

SUMMARY OF THE INVENTION

The above object generally is achieved according to a first aspect of the invention by a method for detaching a manhole frame embedded in a road surface wherein the manhole frame is horizontally detached, starting from the inside, with the aid of a rotating cutting blade that performs eccentric circumferential runs along the inside of the manhole frame.

As a result of the horizontal cut made to the manhole frame from the inside, which is realized with a rotating cutting blade that performs circumferential runs around the circumference at increasing depth up to the manhole frame cone wall on the outside, the manhole frame section can be cut off quickly without having to free it on the outside. There is no danger of damage to the remaining manhole cone due to the smooth cutting, so that the reconstruction is made easier. Since the manhole frame is not cut into smaller pieces, it can then be lifted out in one piece with the aid of a machine once it has been separated on the outside from the connection to the asphalt/concrete road surface. It is particularly advantageous if the manhole frame is separated from the asphalt/concrete road surface and the deeper layers by drilling concentrically around the outside of the manhole frame, up to the depth of the horizontal cut and, if necessary, slightly past it. As a result, uncontrolled retractions and expansions in the asphalt road surface are avoided during this operation. The manhole frame can be replaced without considerable preliminary work or a subsequent reworking of a construction site surrounding the manhole frame and a repaired frame can be released immediately for road traffic.

Preferably, the horizontal cut into the manhole frame is made during several successive circumferential runs of the cutting blade, meaning partial cuts with increasing depth toward the outside of the manhole frame. The cutting depth of each partial run can be adjusted for the essentially circumferential run along the cylindrical inside space of the manhole frame.

The above object generally is achieved according to a second aspect of the invention by a device for detaching an embedded manhole frame, according to the above-mentioned method, with the device generally comprising a rotating cutting blade that is mounted on a turntable such that it can be adjusted horizontally eccentric to the axis of the turntable and that also can be adjusted vertically adjustable. The turntable mounted for rotation on a mounting support with fastening elements that are suitable for locking in place the mounting support inside the manhole frame.

The device can have a compact enough design to be deposited easily with a truck-mounted loading crane at the place of use, above a manhole frame. The detaching device thus requires little road space. If the cutting blade is operated, e.g., made to rotate, preferably with a hydraulic drive motor, the hydraulic system of the truck, which otherwise functions to activate the loading crane, can be used for driving the cutting blade. In further detail, the detaching device with its mounting support is placed over the manhole frame onto the asphalt/concrete road surface, such that the manhole frame is positioned concentrically within the preferably round mounting support. The mounting support is then attached with its fixation or fastening elements to the manhole frame, wherein an additional centering can occur. The cutting blade is subsequently lowered into the manhole frame up to the intended location of detachment from the manhole cone or brickwork. The cutting blade is adjusted eccentrically with respect to the turntable that is mounted for rotation on the mounting support, wherein the cutting blade pushes from the inside against the manhole cone or the brickwork. Flushing water is preferably fed into the rotating cutting blade, and the rotating cutting blade performs a circumferential run along the cylindrical inside wall of the manhole cone or brickwork via the turntable, in particular via a simple manual guide rod assembly. In the process, the cutting blade cuts into the manhole cone or the brickwork. The circumferential runs of the cutting blade along the inside wall are repeated with constant readjusting of the cutting blade until the manhole frame/cone wall is cut through completely up to the outside edge. Several circumferential runs of the cutting blade are thus made with increasing cutting depth toward the outside. With this device for detaching the manhole frame, the above-described functions can be realized reliably. The device is distinguished by its simplicity and robustness and can be automated, in particular for adjusting the cutting blade.

Since the detaching device with the cutting blade is placed against the inside wall of the manhole cone or brickwork, it is not necessary to expose the manhole frame, the manhole cone or the brickwork on the outside.

The subsequent exposure of the manhole frame outside can be reduced to a minimum, so that the manhole frame that is horizontally detached in one piece, or the drill chips, can be lifted out of the pit with the aid of a hoisting device. Thus, the exposure is required only up to the depth of the horizontal cutting location. A hydraulic drill can be used for this reduced exposure, which is suitable for drilling a clearance space around the outside circumference of and concentric to the manhole frame.

It must further be emphasized here that the detaching device does not damage the regions of the manhole cone or brickwork below the cutting location because of the horizontal cutting or detaching method. No repair or reconstruction work on the upper cone edge is therefore necessary.

Details of the features of the detaching device, with its uncomplicated design, generally include a rotating positioning of the cutting blade mounted in a vertically oriented spacer tube, a pivoting arm provided with a first section and, at a distance thereto, a second section, a vertical adjustment of the spacer tube on a first section of the pivoting arm and the positioning of the second section of the pivoting arm such that it can pivot on the turntable for adjusting the eccentricity at the cutting location. The spacer tube in this case is advantageously provided with a device for locking in place the height or depth adjustment of the cutting blade. By pivoting the pivoting arm around its bearing location on the turntable, the eccentricity of the spacer tube and thus the cutting blade is adjusted, so that the cutting blade fits under pressure against the inside or brickwork of the manhole cone.

According to a further feature of the invention, a simple and robust threaded rod is provided for adjusting the eccentricity. This rod, on the one hand, is engaged in a member on the second section of the pivoting arm and, on the other hand, has one end pivotally mounted on the turntable. The threaded rod can be adjusted simply by turning it, thus eccentrically adjusting the pivoting arm as well as the spacer tube and the cutting blade. While lowering the cutting blade, meaning during the height adjustment, this blade is oriented nearly concentric inside the manhole frame. At the operating depth, the cutting blade is then moved eccentrically against the inside wall of the manhole cone or the brickwork.

A hydraulic adjustment of the pivoting arm is also possible, which can furthermore occur automatically.

For a sensitive, but also strong guidance during the circumferential run of the cutting blade for the horizontal cutting operation, a manual guide rod assembly is attached in an uncomplicated manner to the turntable. The guide rod assembly can be designed, for example, to resemble a nearly reversed U-shape, which is bent at an angle to form a lever arm that can be used to manually exert a torque onto the turntable.

According to a further feature of the invention, the turntable can be prevented from turning in one rotational or circumferential run direction by using at least one detent pawl that is positioned on the mounting support for the turntable and engages a toothed edge of the turntable. Even a high torque exerted by the cutting blade during the cutting operation onto the turntable can be absorbed safely in this manner.

The rotational direction of the cutting blade can be reversed, for example, with a hydraulic control unit for a quick realization of the horizontal cut with increasing cutting depth.

According to a still further feature, the mounting support that carries the turntable comprises, in an uncomplicated manner, a ring that can be secured with screws inside the manhole frame and on which the turntable is positioned for concentric rotation.

The invention is explained in the following with the aid of an exemplary embodiment of the detaching device and with the aid of seven Figures.

DESCRIPTION OF THE PREFERRED EMBODIMENTS

Figure 1:
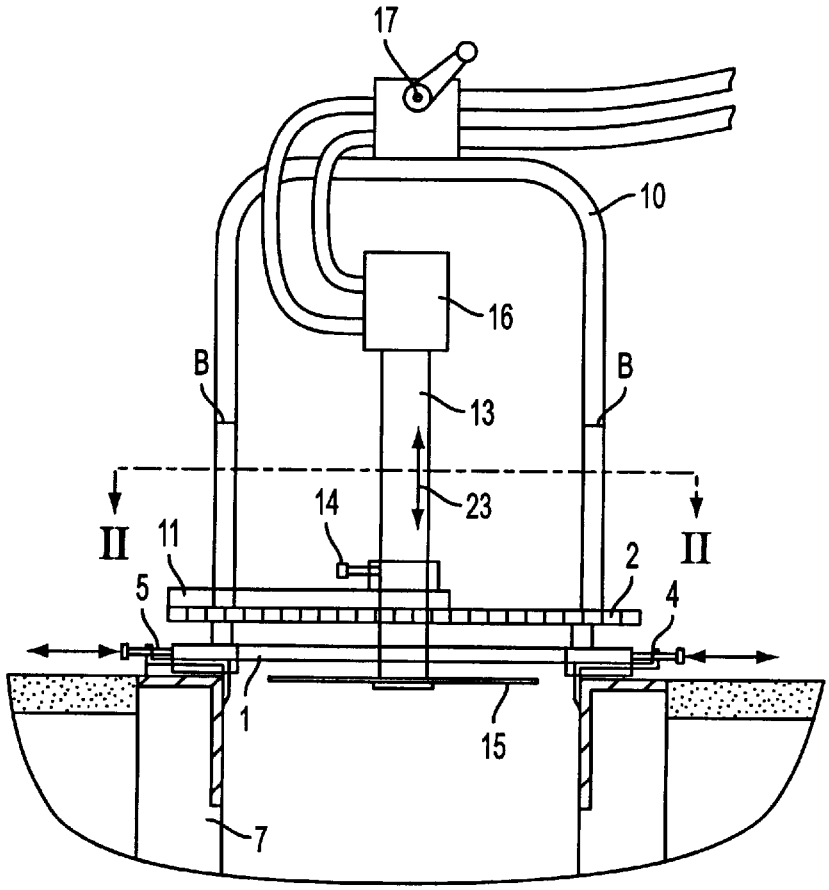
FIG. 1 is a schematic illustration of a first cutting position of the detaching device, according to the invention, seen in a sectional view of the side of the manhole frame.
Figure 2:
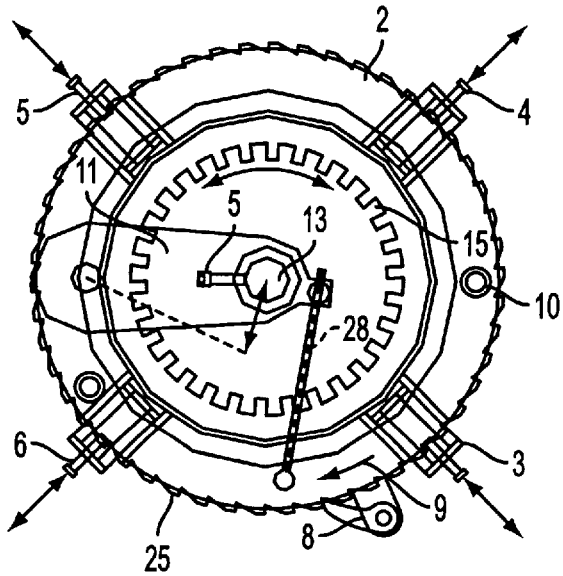
FIG. 2 is a sectional view through the detaching device in the cutting plane II—II shown in FIG. 1.
Figure 3:
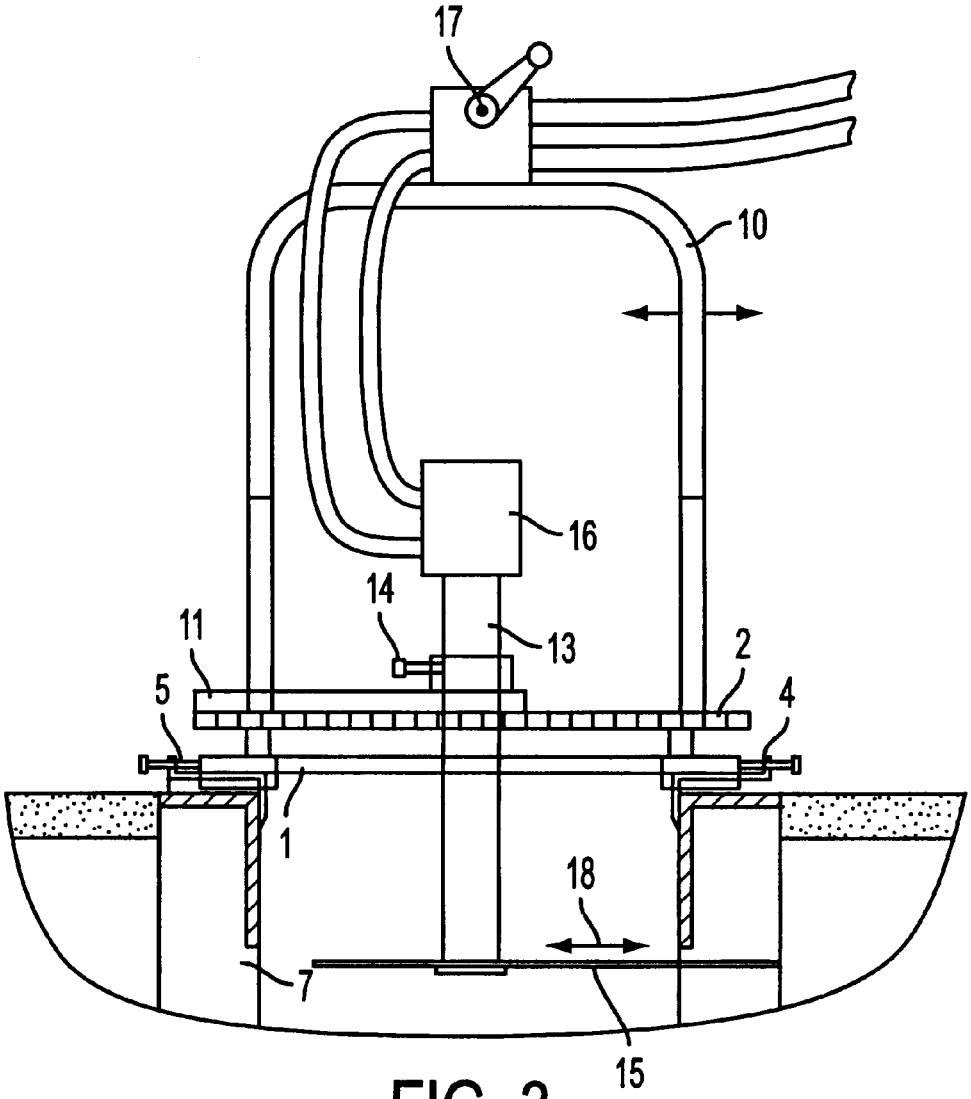
FIG. 3 is a view from the side of the detaching device in a second position.

In FIGS. 1 to 3, the number 1 refers to a ring for a mounting support on which a generally annular turntable 2 is positioned so as to rotate concentrically with the ring. Four fixing or fastening elements in the form of fixing screws 3 to 6 are located evenly spaced in circumferential direction on the ring 1. These screws are used to secure the ring 1 inside a manhole frame 7. For a better view, the fixing elements 4 and 5 are shown somewhat offset in FIGS. 1 and 3. A detent pawl 8 that engages ratchet teeth 25 on the turntable, preferably on the circumferential surface, is furthermore pivotally positioned on the ring 1, which permits the turntable to turn only in the direction of arrow 9.

Attached to the turntable 2 for turning it is an essentially inverted U-shaped manual guide rod assembly 10. This guide rod assembly 10 is bent toward the side on the top and out of the drawing plane at bending locations B, B to generally form a handle for manually turning the turntable 2.

A pivoting arm 11 has a first end or section 27 mounted on the turntable 2 for pivotal movement about a vertical axis 19. The other end, or section 12, of the arm is disposed at a distance from the turntable, and is provided with a collar 26 in which a spacer tube 13 is disposed for axial displacement. The spacer tube 13 can be moved vertically inside the collar 26 of section 12 of pivoting arm 11, and can be locked in place at the specified height with a locking screw 14 disposed in the collar 26. Preferably, the spacer tube 13 is provided with a non-circular shape, e.g., hexagonal, as shown, and the interior of the collar 26 is provided with a mating shape to prevent rotation of the spacer tube 13 relative to the collar 26.

Figure 4:
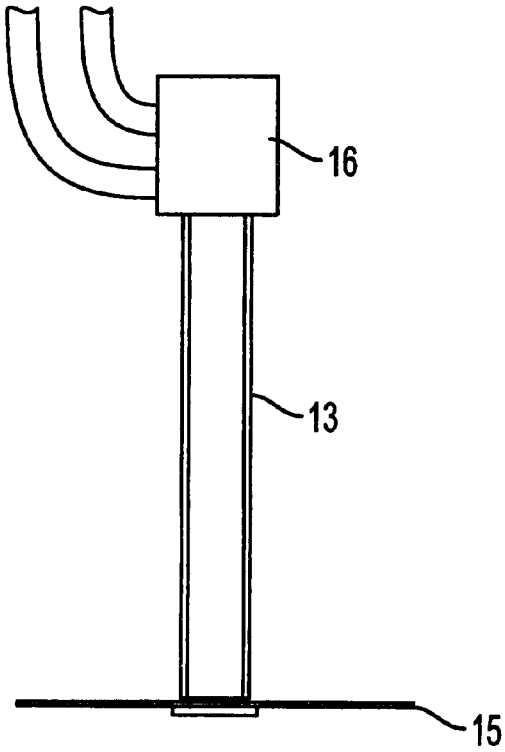
FIG. 4 is a view from the side of a detail of the detaching device, namely the cutting blade connected to a hydraulic drive motor and positioned inside a spacer tube.
Figure 5:
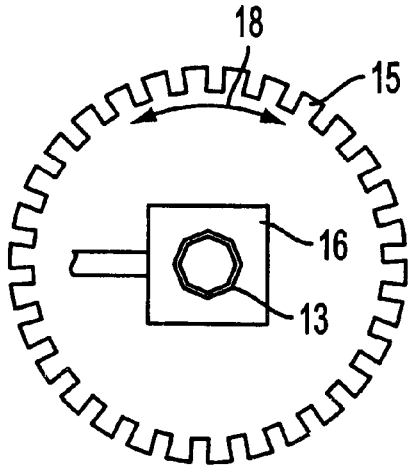
FIG. 5 is a view from above of the detail according to FIG. 4.

A horizontally oriented cutting blade 15 is positioned at the lower end of the spacer tube 13, and is mounted for rotation about the spacer tube 13. The cutting blade is made to rotate with the aid of a drive motor 16, preferably a hydraulic drive motor, as shown, mounted at the upper end of spacer tube 13. The motor 16, and consequently the cutting blade 15, can rotate in one of two possible rotational directions, shown with double arrow 18, depending on the adjustment of a control unit 17, e.g., a hydraulic control unit, as shown. The cutting blade 15, the hydraulic drive motor 16, and the spacer tube 13 are shown separately in FIGS. 4 and 5 for a better illustration. Via a threaded rod 28, the pivoting position of pivoting arm 11, and thus the eccentricity of spacer tube 13 and cutting blade 15 mounted thereon, relative to the turntable 2 and thus the manhole frame 7, can be adjusted within broad limits when the turntable 2, via ring 1 of the mounting support, is placed onto the manhole frame 7.

Figure 6:
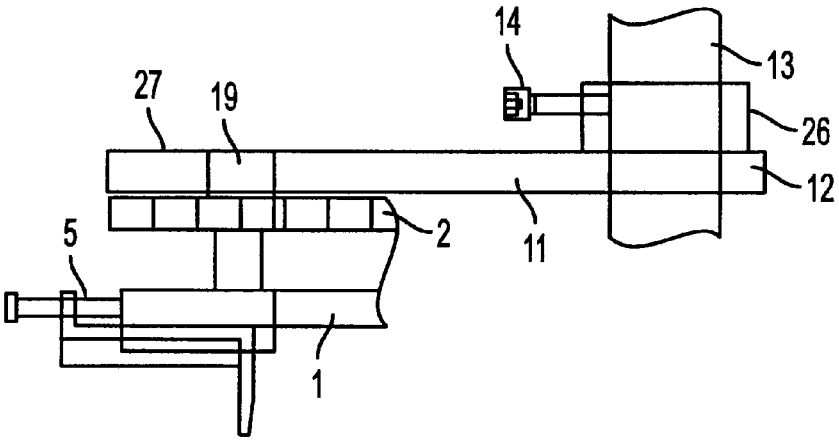
FIG. 6 is a cutout view from the side of another detail of the detaching device, namely the pivoting arm and the elements connected thereto.
Figure 7:
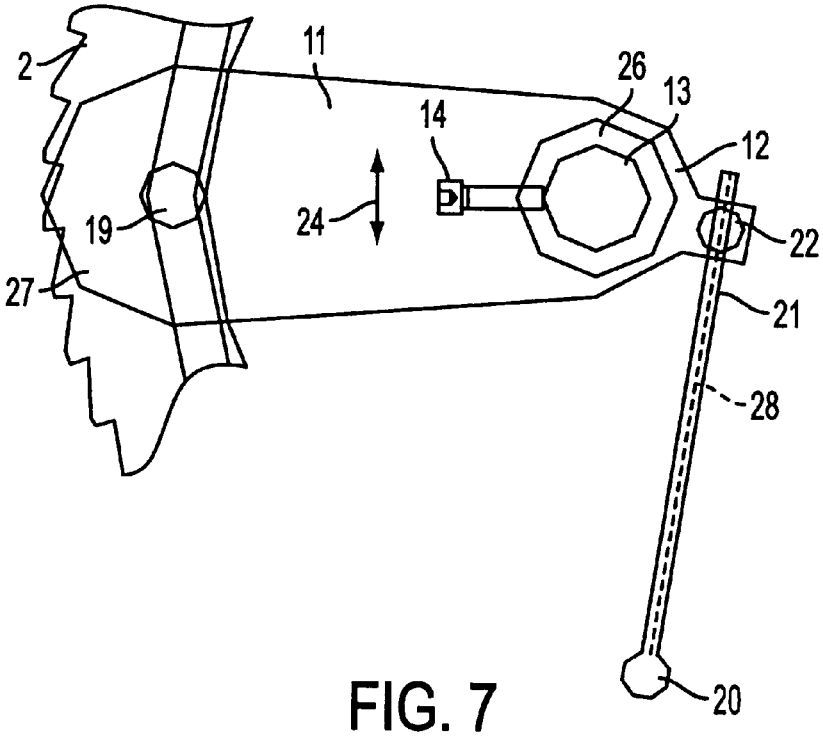
FIG. 7 is a cutout view from above of the additional detail according to FIG. 6.

FIGS. 6 and 7 show the position in which pivoting arm 11 can pivot around the pivoting axis 19 that is arranged on the turntable 2. The pivoting is adjusted with a threaded rod 28. One end 20 of this rod 27 is also mounted on the turntable 2 for pivotal as well as rotational movement, while a section 21, at a distance from the end 20, engages in a threaded member 22 that is pivotally located on the section 12 of the pivoting arm 11. FIGS. 6 and 7 furthermore clearly show the locking screw 14 located in the collar 26 for locking in place the vertical height and depth adjustment of the spacer tube 13.

When fitting the detaching device onto the manhole frame 7, meaning its ring 1 of the mounting support, the spacer tube 13 and thus the cutting blade 15 are initially centered in the ring 1 and turntable 2, as shown in FIG. 1. The placed-on ring 1 is then secured to the frame 7 in a centered orientation with the fastening elements 3 to 6.

Following this, the structural component comprising the spacer tube 13, the cutting blade 15 and the hydraulic drive motor 16 is lowered, as indicated with double arrow 23, with the locking screw 14 loosened, as indicated with double arrow 23. The component is lowered until the cutting blade 15 is at the desired cutting height, as shown in FIG. 3, and then the screw 14 is tightened to secure the cutting blade 15 in the desired position.

Subsequently, the pivoting arm 11 is pivoted by activating the threaded rod 28—see double arrow 24—until the cutting blade 15 is pushed at the desired cutting height against the inside wall of frame 7. At the same time or following this, the drive motor 16 starts the rotation of cutting blade 15 in one of two rotational directions of double arrow 18, depending on the position of the hydraulic control unit 17. The cutting blade 15 cuts into the manhole cone or the brickwork, and the complete horizontal cut is realized by rotating the turntable 2 with guide rod assembly 10 across the entire circumference of the inside wall. The circumferential runs are repeated with increasing cutting depth until the horizontal cutting operation reaches at least the non-designated outside edge of the manhole frame 7, or the manhole cone, or the brickwork. The direction for the circumferential run can be alternately changed as a result of the use of the non-designated hydraulic feed lines. The detent pawl 8 is inactivated for one of the two circumferential directions. Depending on the direction of the turntable 2, the rotational direction for cutting blade 15 can also be reversed with the hydraulic control unit 17, as shown with double arrow 18, to obtain an optimum cutting operation.

The drive motor 16 is subsequently turned off and the cutting blade is reset to the center of the manhole by turning the threaded rod 28. After loosening the fastening elements 3 to 6, the detaching device can subsequently be lifted off the manhole frame 7 and removed with a loading crane.

To remove the detached manhole frame 7, an area must then be drilled concentrically from above around the outside of this frame 7, concentric down to the height of the horizontal cut. The exposed manhole frame 7 can then be removed by lifting it as a whole from the manhole with a hoisting device.

While this invention has been particularly shown and described with reference to preferred embodiments thereof, it will be understood by those skilled in the art that various changes in form and details may be made therein without departing from the spirit and scope of the invention as defined by the appended claims.

What is claimed is:

1. The device for detaching an embedded manhole frame comprising:

a mounting support with fastening elements that are suitable for locking in place the mounting support inside the manhole frame;

a substantially annular turntable mounted on the mounting support for axial rotation;

a rotating cutting blade; and means for mounting the cutting blade on the turntable such that the blade is horizontally adjustable eccentric to the turntable and is also vertically adjustable wherein said means for mounting includes: a vertically oriented spacer tube having the cutting blade disposed at a lower end thereof and in which the cutting blade is mounted for rotation; and a horizontally oriented pivoting arm provided with a first section on which the spacer tube is vertically adjustably mounted, and a second section that spaced from the first section of the pivoting arm, and that is pivotally mounted on the turntable for adjusting the eccentricity of the cutting blade.

2. The device according to claim 1, further comprising a threaded rod connected between the turntable and the first section of the pivoting arm, and at least one end threaded into a member pivotally mounted on at least one of the turntable and the first section of the pivoting arm.

3. The device according to claim 2, further comprising a manually operated guide rod assembly attached to the turntable for manually rotating the turntable.

4. The device according to claim 3, further comprising ratchet teeth disposed on said turntable, and a detent pawl that is pivotally mounted on the mounting support to engage said teeth to block the turntable from turning in one rotational direction.

5. The device according to claim 3, wherein the mounting support comprises a ring having said fastening elements in the form of fixing screws for securing a rim inside the manhole frame and on which the turntable is positioned so as to rotate concentrically.

6. The device according to claim 1, further comprising a hydraulic drive motor connected to the cutting blade for rotating the cutting blade.

7. The device according to claim 6, wherein the hydraulic drive motor is mounted on the spacer tube.

8. The device according to claim 6, further comprising means connected to the motor for selectively controlling the rotational direction of the cutting blade.

* * * * *